United States Patent [19]

Grossman et al.

[11] 4,074,379

[45] Feb. 21, 1978

[54] BOARDING HANDLE FOR BOATS

[75] Inventors: Leroy W. Grossman, 74 Palm Club, Pompano Beach, Fla. 33062; Jack Collins; E. Eugene Kohls, both of Milwaukee, Wis.

[73] Assignee: Leroy W. Grossman, Pompano Beach, Fla.

[21] Appl. No.: 793,746

[22] Filed: May 4, 1977

[51] Int. Cl.[2] ..... B63B 17/00

[52] U.S. Cl. ..... 9/1.6; 16/114 R

[58] Field of Search ..... 9/1.1, 1.6, 1.7; 16/115, 114 R; 182/106; 74/529, 543, 548; 24/213 C, 215

[56] References Cited

U.S. PATENT DOCUMENTS

| | | | |
|---|---|---|---|
| 2,043,007 | 6/1936 | Place | 24/215 |
| 2,905,126 | 9/1959 | Gaffey | 9/1.7 |
| 2,936,465 | 5/1960 | Mayfield | 9/1.6 |
| 3,136,384 | 6/1964 | Sweeney et al. | 182/106 |

FOREIGN PATENT DOCUMENTS

| | | | |
|---|---|---|---|
| 152,129 | 11/1930 | Switzerland | 9/1.7 |

*Primary Examiner*—Trygve M. Blix
*Assistant Examiner*—Stuart M. Goldstein
*Attorney, Agent, or Firm*—Ira Milton Jones & Associates

[57] ABSTRACT

A pair of telescoped inner and outer tubes together provide a post-like handle that is mounted on the gunwale of a boat. The outer tube is fixed to the top of the gunwale and projects down through a hole in the gunwale, and the inner tube which forms the actual handle slides in the outer tube between a lowered inoperative position beneath the gunwale to a raised operative position standing erect and rising to a convenient height above the gunwale. A spring-pressed latch moves with the inner tube and snaps into an annular groove that is fixed with respect to the outer tube and located directly above the gunwale, to secure the inner tube against either upward or downward movement. A resiliently manually actuated loop located in the annular groove enables the latch to be dislodged from the groove when it is desired to lower the handle.

11 Claims, 8 Drawing Figures

BOARDING HANDLE FOR BOATS

This invention is concerned with a problem encountered in boarding and leaving a boat, and especially a power boat of the type having a gunwale onto which a person steps as he boards. The problem is especially serious when, as is so often the case, the gunwale of the boat is at an elevation below that of the dock from which the boarding takes place. Unless another person is present with a helping hand, the boarding operation — or, for that matter, the disembarking manoeuvre — can be, and often is, quite hazardous and difficult. To step from the dock onto and usually down onto the gunwale of a bobbing boat requires a degree of agility not possessed by the average boating enthusiast, and since few of that group can be expected to acquire such agility, a serious need has long existed for a reliable aid to persons boarding or leaving a boat.

This invention satisfies that need, and achieves its objective through the provision of a boarding handle that is easily mounted on the gunwale of any of a wide variety of power boats.

Not only does the invention provide the very welcome assistance that such a handle affords to a person boarding or leaving a boat, but it does so in a manner that allows the handle to be quickly moved from its erect operative position in which it rises above the gunwale to a height that facilitates its being comfortably grasped, to a lowered out-of-sight location beneath the gunwale.

To accomplish the aforesaid objectives, the invention resides in the provision of a boarding handle that is securable to the gunwale of a boat and which comprises inner and outer substantially rigid telescoped tubes which, when unrestrained, are freely axially slidable relative to one another; mounting means at one end of the outer tube by which it — and hence the entire handle — is securable to the gunwale of a boat with the axis of the handle substantially perpendicular to the gunwale and with the telescoped tubes projecting down through a hole in the gunwale into the space therebeneath, so that the inner tube may be moved from a lowered inoperative position substantially entirely below the gunwale and in which position only the upper end of the inner tube is accessible from above the gunwale, to a raised operative position projecting up from the gunwale and vice versa; means by which the raised operative position of the inner tube is defined comprising latch means yieldingly projecting from the external surface of the inner tube, and keeper means fixed with respect to the outer tube to receive the latch means and thereby hold the inner tube against axial movement in either direction with respect to the outer tube, the keeper means being positioned adjacent to said mounting means and so located with respect thereto as to be above the gunwale; and manually operable means by which the latch means may be dislodged from the keeper means to free the inner tube for axial movement with respect to the outer tube.

With these observations and objectives in mind, the manner in which the invention achieves its purpose will be appreciated from the following description and the accompanying drawings which exemplify the invention, it being understood that changes may be made in the specific apparatus disclosed herein without departing from the essentials of the invention set forth in the appended claims.

The accompanying drawings illustrate two complete examples of the embodiments of the invention, constructed according to the best modes so far devised for the practical application of the principles thereof, and in which.

Figures 1, 2, 3, 4:
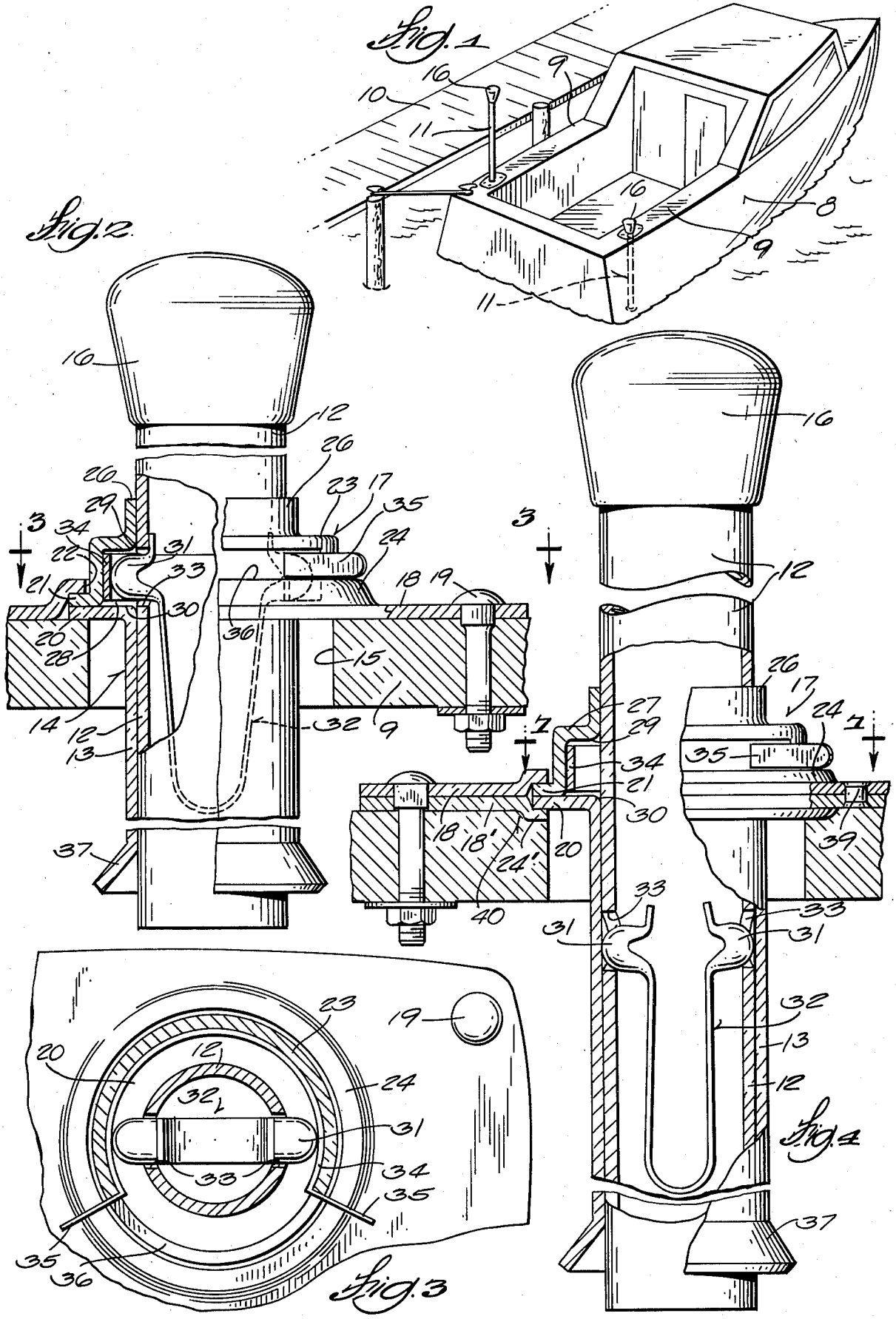
FIG. 1 is a perspective view of a boat equipped with the boarding handle of this invention alongside a dock, to illustrate the manner in which the invention facilitates boarding or leaving a boat.
FIG. 2 is a view of the boarding handle partially in side elevation and partially in longitudinal section, illustrating the handle mounted on a gunwale which is shown in section, and with the handle in its raised operative position and parts thereof omitted to allow the structure to be illustrated at a larger scale.
FIG. 3 is a cross sectional view through FIG. 2 on the plane of the line 3—3.
FIG. 4 is a view similar to FIG. 2, but illustrating a modified embodiment of the invention and showing the handle in a partially lowered position.
Figure 5:
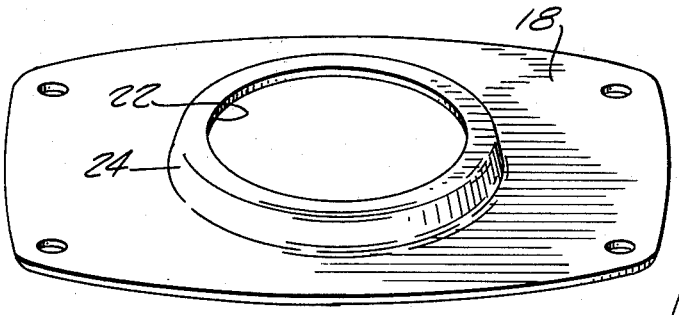
FIG. 5 is an exploded perspective view of the component parts of the stationary mounting structure of the assembly.
Figure 5:
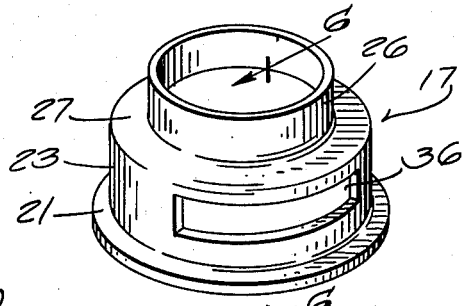

Referring now to the accompanying drawings, the numeral 8 designates a boat that may be regarded as generally illustrative of the wide variety of boats to which the present invention is applicable. As is customary, these boats have gunwales 9 which usually are at an elevation below that of a dock or pier 10 alongside which the boat may be moored. Accordingly, a person boarding or leaving the boat must negotiate the difference in elevation between the dock and the adjacent boat gunwale. Without assistance from another person that step is seldom easy, and often can be hazardous, especially if the boat is bobbing up and down.

To facilitate the manoeuvre and obviate the need for another person's helping hand, a boarding handle designated generally by the numeral 11 is mounted on each gunwale 9. The boarding handle comprises essentially a pair of telescoped rigid inner and outer tubes 12 and 13, respectively. The outer tube is part of a mounting structure, indicated generally by the numeral 14, and projects down through a hole 15 in the gunwale when the boarding handle is in place thereon. Since the mounting structure is solidly secured to the gunwale, the inner tube 12 — being axially slidable in the outer tube — can be quickly and easily raised from an inoperative out-of-the-way position below the gunwale (shown in dotted lines in FIG. 1), to an operative position projecting erect and solidly above the gunwale, as shown in full lines in FIG. 1.

A cap 16 on the upper end of the inner tube 12 provides a handgrip of a size and shape to be comfortably grasped. In the lowered position of the handle (i.e. the inner tube 12), the cap 16 seats upon the mounting structure and thus defines the lowered inoperative position of the handle. In that position, the cap or grip 16 projects but a short distance above the gunwale and hence does not constitute an objectionable obstruction.

It is, however, easily grasped when it is desired to raise the handle to its operative position in which the handgrip is at a convenient height above the gunwale.

In addition to the outer tube 13, the mounting structure comprises a collar 17 and (in the embodiment of the invention illustrated especially in FIG. 2) a single attaching plate 18 that is bolted to the top of the gunwale. Preferably four bolts 19 that may be of the carriage bolt variety are used to secure the mounting structure to the gunwale.

With the attaching plate 18 thus secured to the gunwale, it clamps a flange 20 and an overlying flange 21 to the upwardly facing surface of the portion of the gunwale surrounding the hole 15. The flange 20 is integral with the tube 13 and encircles its upper end, and the flange 21 is the bottommost part of the collar 17. For the plate 18 to perform its clamping function, it has a round hole 22 of a size to snugly fit the cylindrical portion 23 of the collar 17 immediately above its flange 20, and has the marginal portion 24 of that hole offset or displaced upwardly from the general plane thereof. The extent of that upward displacement is slightly less than the combined thickness of the flanges 20 and 21 to assure the desired clamping action.

The upper end portion 26 of the collar 17 which is joined to its cylindrical portion 23 by a flat annular wall portion 27, is of the same diameter as the tube 13 and thus coacts with the latter in slidably mounting the handle-forming inner tube 12.

The collar 17 also coacts with the tube 13 or, more accurately, with the flange 20 at its upper end, to define an annular groove 28. The opposite upper and lower edges 29 and 30 at the mouth of the annular groove are well defined and spaced apart a distance only slightly greater than the diameter of the buttons 31 of a doublebutton leaf spring retainer or latch 32 that is mounted in the inner tube 12. The retainer or latch is held in place in the tube 12 by having its buttons 31 protrude through diametrically opposite holes 33 in the wall of the tube. The holes are so located with respect to the length of the tube that the buttons snap into the mouth of the groove 28 when the tube is raised to its operative position. The buttons 31 and the annular groove thus coact in the manner of a spring-pressed latch and keeper.

The latch 32 is preferably of the type made by the Valco Division of Valley Tool & Die, Inc., of Cleveland, Ohio. As such, it is formed from a single length of stainless spring steel bent into a U-shaped formation. When unrestrained, its legs diverge sufficiently to space the buttons 31 at their outer ends a distance considerably greater than the inside diameter of the inner tube 12. Thus, in the assembled condition of the telescoped tubes, considerble spring force presses the buttons against the inside surface of the outer tube 13 and assures that, upon raising the handle-forming inner tube 12 to its operative position, the latch will be engaged by the entry of the buttons 31 into the annular groove 28.

With the buttons 31 thus engaged in the groove, the inner tube 12 is firmly held against either upward or downward movement until the buttons are dislodged from the groove.

To dislodge the buttons 31 from the groove 28 and thereby free the inner tube 12 for endwise movement in either direction, an arcuate spring steel loop or band 34 is inserted into the annular groove before the collar 17 is assembled with the outer tube 13 and the attaching plate 18. The end portions of this loop are bent outwardly to provide a pair of finger grips 35 that project through an arcuate slot 36 in the cylindrical portion 23 of the collar. The arcuate length of the loop and the distance between its ends are such that, when the finger grips 35 are squeezed together, the diameter of the loop is reduced sufficiently to force the latch buttons out of the annular groove; and, as will be readily understood, the diameter of the arcuate loop — when free — is such that, when in place, its spring tension holds the loop tightly against the bottom of the groove where it does not interfere with the entry of the buttons into the groove.

Inasmuch as the axial dimension of the exposed outer surface of the cylindrical portion 23 of the collar 17 is less than the width of the groove 28, the width of the arcuate slot 36 of necessity must be less than the desired width of the loop, which is preferably only slightly less than the width of the annular groove. Accordingly, the finger grips 35 are narrower than the loop.

Although identification of the materials of which the various components of the invention are made and their specific dimensions is not important to an understanding of the invention, for the sake of completeness of the disclosure, the telescope tubes 12 and 13 are preferably cut from PVC tubing of respectively 1 11/16" and $1\frac{7}{8}$ inches outside diameter, with a one-eighth inch wall thickness. The length of the inner tube 12, of course, determines the height to which the handle can be raised above the gunwale, which should be in the neighborhood of 30" but may not be longer than the height of the space below the gunwale.

The length of the outer tube 13 should be sufficient to provide stability for the handle in its raised operative position. Six inches has been found to be satisfactory for that dimension if the securement of the outer tube to the gunwale is sufficiently stable, but if that is not the case the needed stability can be achieved by increasing the length of the outer tube 13 an amount necessary to enable its securement to a support well beneath the gunwale. This can be done in any suitable way and is therefore not illustrated.

If the required stability can be obtained without securing the outer tube to a support beneath the gunwale, in all probability the inner tube 12 will project below the bottom end of the stationary outer tube 13 when the former is in its lowered inoperative position. In this case, the latch forming-buttons 31 would leave the bottom of the outer tube as the inner tube is lowered, making it necessary to provide some means for depressing the buttons as the inner tube is again raised. For this purpose the bottom end portion of the outer tube can be provided with an outwardly flared skirt portion 37 extending around the entire circumference of the tube, as shown, or only at diametrically opposite portions thereof. In either case, the skirt portion cams the buttons in as the inner tube is raised. The diameter of the skirt portion 37 would then determine the minimum diameter of the hole 15 in the gunwale.

Preferably the collar 17 and the attaching plate 18 are formed of chrome-plated brass, and - as already noted - the spring latch 32 and the arcuate loop or band 34 are preferably of stainless spring steel.

Figure 8:
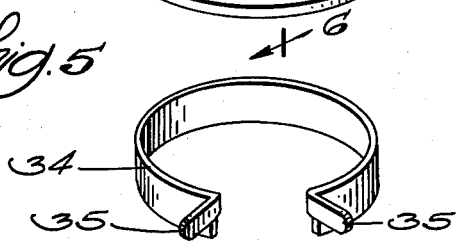
FIG. 8 is a detail view similar to the medial portion of FIGS. 2 and 4, illustrating a slight modification by which removal of the handle from its mounting structure is prevented.
Figure 8:
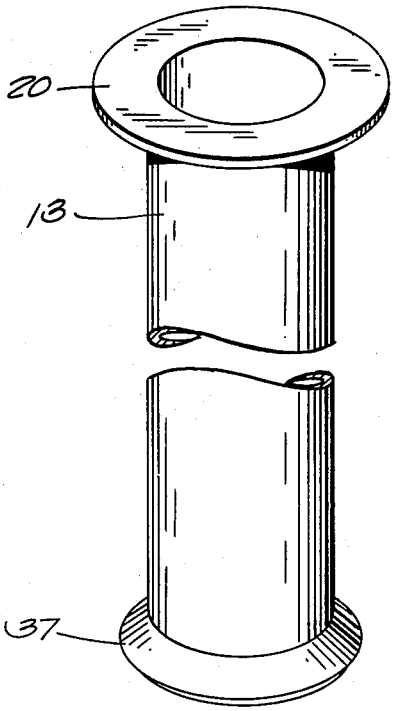
Figure 6:
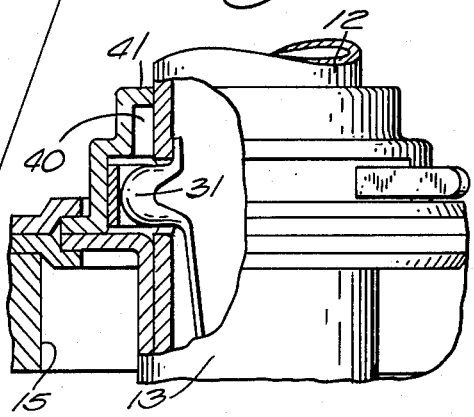
FIG. 6 is a detail sectional view on the plane of the line 6—6 through one of the component parts shown in FIG. 5.
Figure 6:
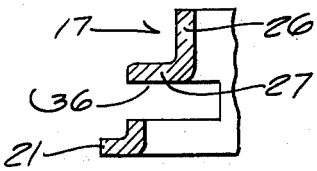
Figure 7:
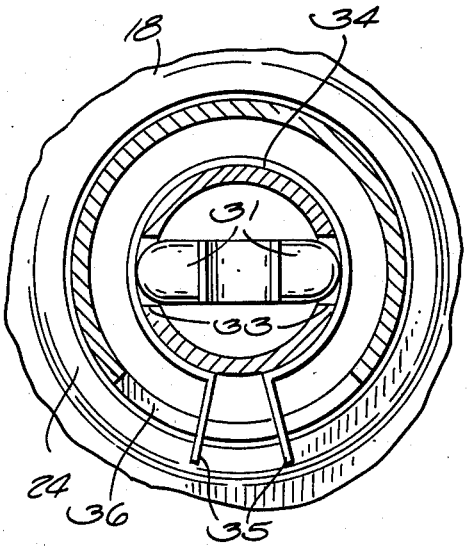
FIG. 7 is a cross sectional view through FIG. 4 on the plane of the line 7—7.

In the embodiment of the invention especially illustrated in FIG. 2, there is no provision for holding the telescoped tubes assembled with the attaching plate 18 and the collar 17 before the installation of the handle on the gunwale of a boat. That deficiency — if it is considered one — is eliminated in the modified embodiment of the invention illustrated in FIG. 4 by the simple expedient of providing a second plate 18' which may be identical in size and shape with the attaching plate 18; and securing the two plates together as by rivets 39, with the overlying flanges 20 and 21 clamped therebetween. Not only does the addition of the second plate hold the various parts assembled, it automatically centers the handle in the hole through the gunwale. This result flows from the presence of the shoulder 40 formed by the offset 24' of the lower plate. As will be evident, the engagement of this shoulder with the edge of the hole 15, as shown in FIG. 8, or its reception in a counterbore at the mouth of the hole, as in FIG. 4, obviates the need for the use of an appropriate centering template to properly locate the holes through which the securing bolts pass, as is necessary in the FIG. 2 embodiment.

In the embodiments of the invention illustrated in FIGS. 2 and 4, upward withdrawal of the handle from its mounting structure is possible since, upon expulsion of the latch buttons 31 from the annular groove 28 by means of the loop or band 34, the inner tube 12 is freed for endwise movement in either direction. In the event removal of the handle is objectionable for some reason, the collar 17 can be provided with a stepped formation, as shown in FIG. 8, wherein the annular groove 28 opens into a smaller diameter annular space 40 which is closed at its top by the end wall 41 of the collar. In effect, this space provides a second annular groove for the reception of the latching buttons, from which they can only escape in the downward direction. And since the grip-forming cap 16 prevents downward removal of the tube 12 from the mounting structure, once assembled the component parts of the entire structure will remain so.

Those skilled in the art will appreciate that the invention can be embodied in forms other than as herein disclosed for purposes of illustration.

The invention is defined by the following claims:

We claim:

1. A boarding handle securable to the gunwale of a boat to facilitate boarding and leaving the boat, comprising:

A. inner and outer substantially rigid telescoped tubes which when unrestrained are freely axially slidable relative to one another;

B. mounting means at one end of the outer tube by which it, and hence the entire handle, is securable to the gunwale of a boat with its axis substantially perpendicular to the gunwale and with the telescoped tubes projecting down through a hole in the gunwale into the space therebeneath, so that the inner tube may be moved between a lowered inoperative position substantially entirely below the gunwale in which position only its upper end is accessible from above the gunwale, and a raised operative position projecting up from the gunwale;

C. means by which the raised operative position of the inner tube is defined, said last named means comprising (1) latch means yieldingly projecting from the external surface of the inner tube, and (2) keeper means fixed with respect to the outer tube to receive said latch means and thereby hold the inner tube against axial movement in either direction with respect to the outer tube, said keeper means being positioned adjacent to said mounting means and so located with respect thereto as to be above the gunwale when the handle is secured thereto; and D. manually operable means by which said latch means may be disengaged from the keeper means to free the inner tube for axial movement with respect to the outer tube.

2. The boarding handle defined by claim 1, further characterized by means defining the lowered inoperative position of the inner tube.

3. The boarding handle defined by claim 1, wherein said keeper means comprises an annular groove encircling the inner tube and defined by structure adjacent to said mounting means and the contiguous end of the outer tube.

4. The boarding handle defined by claim 3, wherein said latch means comprises a button on an end portion of a U-shaped leaf spring located in the inner tube with said button protruding through a hole in the wall of the inner tube.

5. The boarding handle defined by claim 3, wherein said structure that coacts with the contiguous end of the outer tube to define said annular groove is a collar that encircles the inner tube, wherein the mouth of said annular groove is defined by axially opposed relatively sharp edges, one of which is said contiguous end of the outer tube and the other of which is the inner edge of an annular wall that projects inwardly from one end of a substantially cylindrical wall of said collar, and wherein said manually operable means (paragraph E. of claim 1) comprises (1) an arcuate spring loop with spaced apart ends, said spring loop being inside said annular groove and yieldingly maintained by its own resilience in contact with the inner surface of said substantially cylindrical wall of the collar, and (2) outwardly directed finger grips on the spaced apart ends of said spring loop projecting through a slot in said substantially cylindrical wall of the collar to provide means by which the ends of said spring loop can be drawn towards one another to reduce its diameter and thereby dislodge the latch means from said annular groove.

6. The boarding handle of claim 5, wherein said collar has an outwardly directed flange at the other end of its substantially cylindrical wall, wherein the contiguous end of the outer tube terminates in an outwardly directed flange, wherein the outwardly directed flanges on the collar and the outer tube overlie one another, and wherein said mounting means comprises a plate having a hole through which the collar protrudes with its substantially cylindrical wall closely adjacent to the edge of said hole, so that upon securement of said plate to a gunwale, the overlying flanges on the collar and on the outer tube are clamped between the gunwale and said plate.

7. The boarding handle of claim 6, wherein said mounting means further comprises a second plate having a hole therethrough to accommodate the collar, wherein the overlying flanges on the collar and on the outer tube are clamped between the portions of said plates that encircle the holes in said plates, and wherein said plates are secured together so that the telescoped tubes and the mounting means for the outer tube are maintained in assembled relation independently of the gunwale upon which the handle may be mounted.

8. The boarding handle of claim 5, wherein the upper end portion of the inner tube projects above said collar when the handle is mounted on a gunwale, and wherein a handgrip on the upper end of the inner tube seats upon the collar when the inner tube is in its fully lowered position to thereby define said lowered position.

9. The boarding handle of claim 8, wherein the inner tube is longer than the outer tube so that in its lowered inoperative position it projects from the bottom end of the outer tube when the handle is mounted on a gunwale, wherein said latch means comprises a button on an end portion of a U-shaped leaf spring located in the inner tube, with said button protruding through a hole in the wall of the inner tube at a location lengthwise thereof that is outside the outer tube when the inner tube is in its lowered inoperative position, and wherein the bottom end of the outer tube is flared outwardly to provide a cam surface by which said protruding button is depressed as the inner tube is raised from its lowered inoperative position.

10. The boarding handle of claim 9, wherein said U-shaped leaf spring has a button on each end thereof and said buttons protrude through holes in the wall of the inner tube that are coaxial and diametrically opposite one another, so that in the operative position of the inner tube, each of two diametrically opposite portions of said annular groove has one of said buttons received therein.

11. The boarding handle of claim 5, further characterized by:

structure defining a second annular groove that is smaller in diameter than the one recited in claim 3, said grooves communicating with one another so that the latching button can enter said second annular groove upon being dislodged from the larger groove to thereby prevent upward removal of the inner tube from the mounting means.

* * * * *